United States Patent [19]

Schmidt et al.

[11] 4,031,838

[45] June 28, 1977

[54] MODULAR INTERCHANGEABLE WEAPONS SUB-ASSEMBLY SYSTEM FOR WARSHIPS

[75] Inventors: Willy Schmidt, Ellerbek, Kr Pinneberg; Karl-Otto Sadler, Hamburg, both of Germany

[73] Assignee: Blohm & Voss AG, Hamburg, Germany

[22] Filed: Dec. 24, 1975

[21] Appl. No.: 644,316

Related U.S. Application Data

[63] Continuation-in-part of Ser. No. 521,083, Nov. 5, 1974, abandoned, which is a continuation of Ser. No. 399,245, Sept. 20, 1973, abandoned, which is a continuation of Ser. No. 198,510, Nov. 15, 1971, abandoned.

[30] Foreign Application Priority Data

Nov. 14, 1970 Germany ..... 2056069

[52] U.S. Cl. ..... 114/1; 89/37 R; 89/37 G; 114/77 A; 114/201 R; 264/263

[51] Int. Cl.[2] ..... B63G 1/00

[58] Field of Search ..... 89/1.802, 36 F, 36 H, 89/36 Z, 36 J, 36 K, 37 R, 37 G, 40 B; 114/1, 5, 6, 7, 8, 77 R, 77 A, 78, 201 R, 203; 264/31, 263

[56] References Cited

UNITED STATES PATENTS

| | | | |
|---|---|---|---|
| 377,732 | 2/1888 | Adams | 89/36 F |
| 3,024,704 | 3/1962 | Even | 89/37 R |
| 3,261,262 | 7/1966 | Hilfing et al. | 89/36 K |
| 3,367,234 | 2/1968 | Neuman et al. | 89/1.802 |
| 3,371,639 | 3/1968 | Schillreff | 114/77 A |
| 3,466,969 | 9/1969 | Stangl et al. | 89/40 B |
| 3,566,742 | 3/1971 | Bemiss | 89/40 B |

*Primary Examiner*—Stephen C. Bentley
*Attorney, Agent, or Firm*—Toren, McGeady and Stanger

[57] ABSTRACT

The weapons units of a warship may be formed in remotely prefabricated modular sub-assemblies which are capable of interchangeable mounting at different locations on the warship by an arrangement which includes a standardized adapter device structurally formed as part of the warship and defining the opening of a compartment into which the modular sub-assembly of the weapons unit is mounted. The weapons unit modular sub-assembly consists of a container within which the weapons unit is prefabricated. The weapons unit container and the adapter unit on the warship are both formed with mating structural parts having standardized sizes and configurations in order to enable interchangeability of the sub-assemblies. Although each sub-assembly may be formed with a different weapons unit, the container for the weapons unit of each sub-assembly is uniformly structured in a standardized manner complementing the adapter unit on the warship. The container unit is formed with a horizontal flange which overlies a horizontal flange of the adapter unit when the weapons sub-assembly is in mounting position. A pair of L-shaped rims, one each on the container unit and the adapter unit, respectively, form a L-shaped annular gap about the weapons sub-assembly within which resilient sealing means are poured in order to effect a fluid-tight seal between the weapons sub-assembly and the ship's structure. The horizontal flange of the adapter unit forms a platform for mounting the weapons sub-assembly and for enabling adjustment of the position and orientation of the sub-assembly prior to rigid connection thereof to the warship. Pins extending vertically upwardly from the flange of the adapter unit are located around the opening of the ship's compartment for mating engagement with alignment holes through the flange of the weapons container to effect lateral alignment of the weapons unit sub-assembly in mounting position. Adjustment of the orientation of the weapons unit is effected by screw means which extend upwardly from the adapter unit flange for abutment with the underside of the flange of the container of the weapons sub-assembly. By adjustment of the screw means, tilting of the weapons sub-assembly may be effected to adjust its orientation into a desired attitude whereby the sub-assembly may be rigidly connected to the warship by pouring of the sealing means and by fastening of attachment bolts.

7 Claims, 4 Drawing Figures

MODULAR INTERCHANGEABLE WEAPONS SUB-ASSEMBLY SYSTEM FOR WARSHIPS

This application is a continuation-in-part application of pending prior application Ser. No. 521,083 filed Nov. 5, 1974, which, in turn, was a continuation of Ser. No. 399,245 filed Sept. 20, 1973, which itself was a continuation of Ser. No. 198,510 filed Nov. 15, 1971.

BACKGROUND OF THE INVENTION

The present invention relates generally to the mounting of operational units, such as weapons units, radar units and the like, upon warships, and more particularly to an installation system which involves remote prefabrication of the weapons unit into a modular sub-assembly having standardized mounting parts mating with standardized parts on the warship. By virtue of the structure of the invention, interchangeability of the modularized operational unit sub-assemblies enables removal of one operational sub-assembly from a mounting location in a ship and replacement thereof by another different operational unit which has been prefabricated into a similar sub-assembly having standardized mounting parts mating with the mounting parts on the warship. The invention specifically relates to the particular structure of the mounting arrangement and to a method for interchangeably mounting the weapons units upon the warship.

It should be understood that, in the practice of the present invention, different types of operational units may be involved and the invention is not necessarily limited to warships or to weapons units. Radar installations, fire control equipment and even radio facilities may comprise the operational unit which is prefabricated into the modular sub-assembly. Thus, the term "operational unit" as used herein is intended to refer without limitation to a variety of devices and the invention may be appropriately applied in various types of seagoing vessels including warships.

In the installation of the type of device to which the present invention relates, it has heretofore been necessary to perform extensive preparatory operations in order to adapt the installation site to receive the individual parts to be mounted. Since such installations have generally been performed by utilizing techniques whereby individual parts are separately mounted in place upon a ship, the ship's structure must be prepared to receive the parts so that they may be assembled into structural groups to enable their proper operation. Thus, it is only after performance of the necessary preparatory operations on the ship that the individual parts of the operational device can be consecutively installed in a step-by-step procedure which must be performed in dependence upon the facilities of construction available at the shipyard site.

Significant delay in the shipyard construction of such devices occurs, however, because of the consecutive nature of the installation whereby individual components must be separately installed. Thus, prior art methods of installation are generally accompanied by the disadvantage that extensive time is necessary for their performance.

Furthermore, other difficulties may be encountered. Before the individual components may be delivered to the shipyard for installation, they must be completely finished in production and they must be subjected to tests at a shore facility. Thereafter, disassembly of the assembled parts must be performed and the individual parts must then be packed, shipped, and delivered to the installation site at the shipyard. Furthermore, if required, they must also be stored and then, according to the progress involved in the construction of the ship, they must be again assembled on board the ship and again subjected to functional testing.

As a result, a great amount of duplication in the procedures involved will occur with techniques such as those discussed above. This will cause the incurrence of appreciable costs which will be difficult to determine with accuracy and will involve significant expenditure of time thereby decreasing shipyard efficiency and productiveness.

Accordingly, the present invention is aimed toward simplifying the procedures which are involved in the mounting of operational units upon seagoing vessels. The invention is intended to improve the efficiency of the construction procedures which are utilized while reducing costs as well as the time required for construction. In addition, the invention imparts greater versatility to the operational units which are to be mounted shipborad in that, because of the prefabrication techniques involved, particular operational units may be interchangeably mounted at different desired locations on the ship without ncessitating extensive restructuring procedures.

SUMMARY OF THE INVENTION

Briefly, the present invention may be defined as a containerized modular assembly particularly for interchangeable mounting of operational units on warships or the like by remote prefabrication of the operational units into modular operational unit sub-assemblies capable of being interchangeably mounted upon said warships by standardized uniformly configured mounting means, said assembly comprising an operational unit, container means having said operational unit mounted therein in a manner to enable functioning interconnection of the operational unit with the warship when mounted thereon, said operational unit and said container means being structurally combined as a unitary prefabricated modular operational unit sub-assembly which is manufactured at a site remote from the shipboard mounting location, means defining on the warship a compartment adapted to receive therein the modular operational unit sub-assembly, adapter means including portions thereof defining adapter mating means formed of a standardized predetermined size and configuration, said adapter means being structurally formed as a part of the warship to devine an opening for said compartment, container mating means formed from part of said container means with a standardized predetermined size and configuration complementary to the size and configuration of the adapter mating means, said adapter mating means and said container mating means being in mounting engagement with each other to operatively mount said operational unit sub-assembly upon the warship within said compartment, adjustment means interposed between the adapter means and the container means for enabling adjustment of the position and orientation of the operational unit relative to the warship after the sub-assembly has been introduced into said compartment and movably mounted in position by engagement between the adapter mating means and the container mating means, resilient sealing means extending in sealing engagement completely around the container means between the adapter mating means and the container mating means to form a fluid-tight seal therebetween, and means for enabling application of said sealing means to effect said fluid-tight seal after said operational unit sub-assembly has had its position and orientation relative to the warship adjusted by operation of the adjustment means, with means being provided for enabling separation of the sealing means from between the adapter mating means and the container mating means to facilitate dismantling of the operational unit sub-assembly from the warship and mounting in the place thereof of another prefabricated modular operational unit sub-assembly having container means with substantially identical standardized container mating means.

In one aspect of the invention a separating agent is coated upon the container mating means to facilitate the separation of the sealing means from the container mating means thereby facilitating dismantling of the modular operational unit sub-assembly from its mounting location on the ship.

The adapter mating means and the container mating means are each formed to include complementary L-shapd rims forming an L-shaped annular gap therebetween which extends completely around the container means and which is adapted to receive therein the resilient sealing means. An annular sealing ring is applied in abutting relationship between the adapter mating means and the container mating means closing off the innermost side of the annular gap and the sealing means, while in a fluid state, is poured into the annular gap through orifice means spaced around the container means in flow communication with the annular gap on the outermost side thereof with the annular sealing ring enabling in situ hardening of the plastic sealing compound.

In order to ensure that the modular operational unit sub-assembly is properly aligned on the ship at the mounting site, pin means are arranged to become engaged between the adapter means and the container means when the modular operational unit sub-assembly is placed in mounting position upon the warship. The pin means extend through alignment holes in the container means to effect proper lateral positioning of the modular sub-assembly shipboard at the mounting site with the pin means engaged within the alignment holes on the container means, adjustment screw means may be actuated to provide proper orientation for the attitude of the modular operational sub-assembly. The screw means extend upwardly from the adapter means into abutment with the underside of a flange extending from the container means. After proper alignment and positioning of the modular sub-assembly, the plastic sealing means may be poured in place and hardened and the unit securely mounted, by bolts or the like, to rigidly connect the sub-assembly at its mounting location.

In accordance with the method of the invention, the operational unit system is preassembled as a complete, closed unit at a manufacturing site remote from its shipboard mounting location. The unit may be tested for functional capability and delivered to the shipyard as a completed unit which may be readily installed upon the warship. Of course, during such installation, the operational unit may be connected with various shipboard outlets for supplying the necessary inputs to the operational unit, such as, power sources and the like.

Through utilization of the present invention, several distinct advantages arise with regard to a shipboard installation of the type contemplated. The ship as well as the operational unit sub-assembly may both be produced simultaneously as new structures separately from one another and they may be combined through simple insertion and attachment of the finished units in a short period of time. The production operations which must be performed at the shipyard will be limited to production of a corresponding mounting foundation upon the ship itself, insertion of the operational units and provision of connection of the operational units with the ship's energy supply means. The result will be a saving in labor costs for the installation. When it is necessary to effect repairs and maintenance, a complete operational unit may be transferred to a shore site without extensive auxiliary work and a complete operational test may be performed without influence by other repair or reconditioning work which may be in progress on board ship. A quick exchange of operational units is possible and thus, reserve units which have already been prefabricated may be stored and utilized on short notice. Furthermore modernization of shipboard installations is enabled with greater facility. The testing of new units may be achieved independently of the ship and new units may be exchanged for old units. Through the interchangeability of the unit system of the present invention, different arming alternatives are possible without substantial construction alterations in the vessel. Thus, a special advantage of the invention arises in that rapid arming of auxiliary warships is possible.

The installation of a unit in accordance with the present invention requires a water-tight space in the hull of a ship which may be used for a frame construction closely surrounding the unit. The frame may, however, also form a part of a larger frame serving also for other purposes. In the latter case, the frame when built outside the hull is accessible from all sides and on its inside it may contain all the necessary devices for an operational unit system which, may be obtained, if necessary, by means of the interposition of shock absorbers.

The structure of the present invention will generally involve a foundation which will be indentical for all of the operational unit systems. A necessary horizontal plane will be produced without truing. Detachment of the unit system will be positive and must be easily releasable and waterproof. Horizontal and vertical forces resulting from dead weight acceleration and impact forces will be transmittable. The required space for all operational unit systems must not exceed a predetermined maximum size. Energy supply lines on the ship will be required which will be easily connectable and quickly releasable. The requirements discussed above will be fully complied with in that, for example, the foundation on a ship is constructed in the same manner for all operational unit systems which are employed with connecting flanges on all platforms having the same dimensions. By constructing the foundation on the ship in such a manner that during insertion of the operational unit system the system is first mounted on adjusting screws and by adjustment the plane of the weapon is arranged parallel to the principal measuring plane, and by the introduction of the liquid plastic sealing means and hardening thereof, a necessary mounting plane is produced which eliminates the necessity for a truing operation.

After hardening of the plastic material forming the sealing means, holes are bored for the insertion of the final mounting screws and such screws are inserted and tightened. By employing the principle of attachment of the present invention, an operational unit system may be connected with a ship solely by means of the foundation of the ship and need not be attached to any other part of the structure of the ship. During removal of the operational unit, it will only be necessary to remove the attachment screws inasmuch as the operational unit system may be raised after the energy supply lines forming part of the ship have previously been disconnected from the unit. Preferably, all the parts of the construction which come into contact with the plastic may be painted with an agent which prevents adhesion of the plastic thereto. Preferably, in the performance of the present invention, only the modular operational unit system is coated with the separating agent and the plastic is permitted to adhere to the adapter unit which is formed as part of the structure of the ship.

The sealing means of the invention, in addition to operating as a fluid-tight seal, also allows forces which are encountered to be absorbed by the plastic not only in a vertical direction with respect to the foundation but also in a horizontal direction of the deck of the ship while the attachment screws prevent the raising of the operational unit system. In the event that the operational system extends downwardly of a lower portion of the deck of a ship, care must be taken that at this point elastic seals are arranged which ensure watertightness but which do not create any undesired forces.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
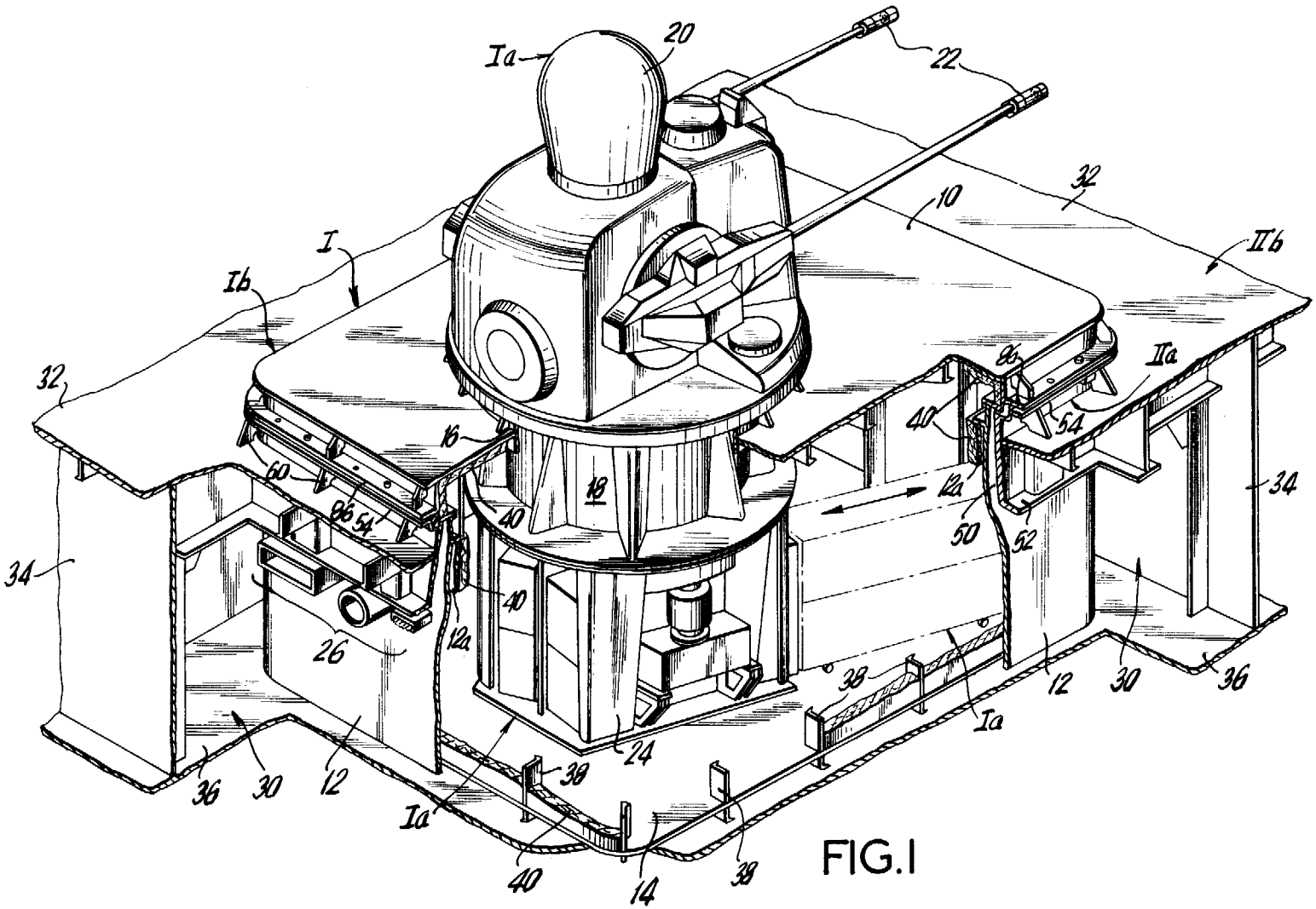
FIG. 1 is a perspective view with parts broken away showing the overall assembly of the invention with a modularized operational unit sub-assembly shown in its mounted position within the compartment of a ship having its opening defined by the adapter means of the invention mating with complementary means on the sub-assembly.

Referring now to the drawings, wherein like reference numerals are used to refer to similar parts throughout the various figures thereof, the overall assembly of the present invention is depicted in FIG. 1 and is shown as basically comprising a prefabricated modular operational unit sub-assembly I which is composed of an operational unit I*a* and container I*b*. The operational unit I*a* shown in the drawings is a weapons unit but it is to be understood that other types of operational units, such as radar units or the like, may be prefabricated together with the container unit I*b* to form the modular operational unit sub-assembly I of the invention and the term "operational unit" as defined herein is intended to refer to all units of this type.

The modular sub-assembly I is mounted in the superstructure of a ship by means of an adapter unit II*a* which defines the opening of a compartment for receiving the modular sub-assembly I, the compartment being formed by a portion II*b* of the superstructure of the ship within the modular sub-assembly I is to be mounted.

Figure 2:
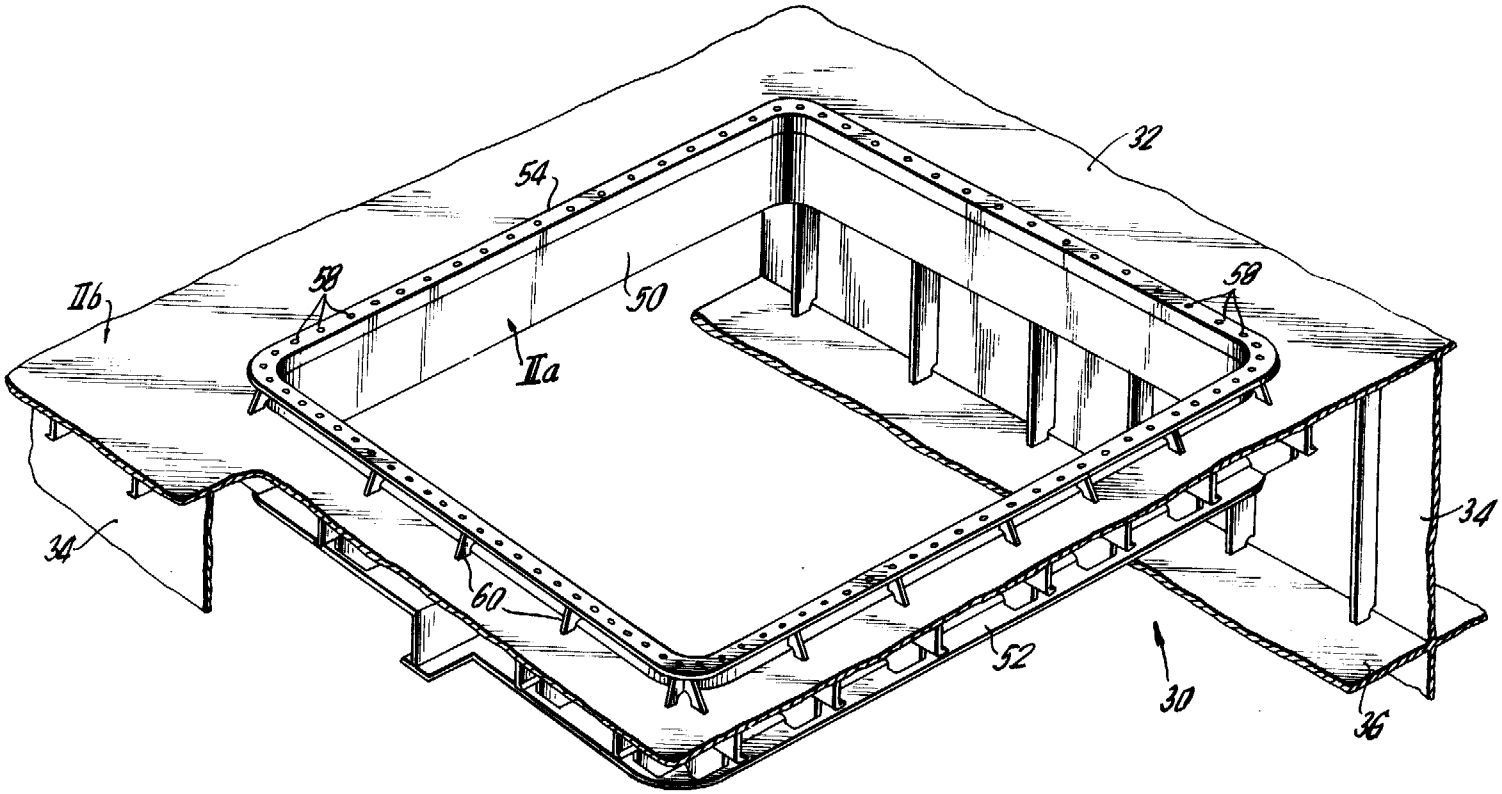
FIG. 2 is a perspective view depicting the portion of the ship within which the modular operational unit sub-assembly is mounted shown without the sub-assembly mounted therein and better depicting the adapter means which are provided on the ship's structure to mate with complementary parts on the sub-assembly.

FIG. 1 shows the modular sub-assembly in its mounted position and FIG. 2 depicts the ship's superstructure II*b* and the adapter II*a* before insertion therein of the modular sub-assembly I.

The adapter unit II*a* is constructed with uniform or standardized dimensions and on any given vessel, a plurality of such standardized adapter units II*a* may be provided in order to define on the vessel mounting sites adapted to receive therein any one of a plurality of modular sub-assemblies which have been constructed, in a manner to be more fully described hereinafter, with standardized parts adapted to mate in a complementary fashion with standardized parts of the adapter units II*a*.

The modular sub-assembly I may be prefabricated at a location remote from the mounting location on the ship defined by the adapter unit II*a*. The operational or weapons unit I*a* may vary widely in size, configuration and dimensions but the container unit I*b* must invariably be formed with parts thereof adapted to engage parts of the adapter unit II*a* in a standardized fashion thereby enabling interchangeability of the modular sub-assembly I from one mounting location on a ship to any of a plurality of other mounting locations. Thus, the parts or elements of the sub-assembly I which interconnect the operational unit I*a* with the container I*b* may be of varying configurations but the outer or peripheral portions of the container unit I*b* will be formed with uniform standardized dimensions.

The modular sub-assembly I may be prefabricated at a location remote from the mounting site on the ship and adapted for insertion into the compartment defined by the portion II*b* of the ship's superstructure in a manner which will enable operational interconnection of the operational unit I*a* with power and support elements on the ship. For example, the operational unit I*a*may be assembled with the conatiner unit I*b* in a manner which will permit connection of the operational unit I*a* with means for supplying electrical current, water and air to the operational unit when it is functionally mounted in place upon the vessel.

As best seen in FIG. 1, the container unit I*b* comprises a top or cover member 10, upstanding side walls 12 and a floor or bottom wall 14. The weapons unit I*a* is supported as shown within the container unit I*b* and is enclosed about the bottom portion thereof by the walls 10, 12, and 14 of the container unit.

Since the operational or weapons unit I*a* may be of varying design and configuration, and since its specific nomenclature is not a part of the present invention and may vary within the scope of the invention, the various parts of the operational unit I*a* are not described in detail. However, the operational unit I*a* is depicted in the drawing of FIG. 1 in sufficient detail to illustrate the manner in which such a unit may be prefabricated within a container unit such as the unit I*b* in accordance with the teachings of the present invention.

As shown in FIG. 1, the cover or upper wall 10 of the container unit I*b* may comprise a rim portion 16 within which there is rigidly attached the midstructure 18 of the operational unit I*a*. A turret 20 of the operational unit I*a* comprising guns 22 extends above the cover or top wall 10 and the substructure 24 of the unit I*a* may be supported upon the bottom wall 14 of the container unit I*b*. The operational unit I*a* may be supplied from the ship with electrical current, water and air, or other similar functional prerequisites through supply connections 26 which extend through the side wall 12 of the container unit and which are adapted to be mated with appropriate outlets (not shown) located within the superstructure of the ship.

The ship's superstructure II*b* defines a compartment 30 which is enclosed by a deck section 32 on the upper side thereof, side frames 34 and an underframe wall 36 within which the modular sub-assembly I is inserted. The bottom wall 14 of the container unit I*b* may be provided with pedestal members 38 which may provide additional support for the sub-assembly I by bearing against the underframe 36 of the ship's superstructure.

The container unit I*b* is formed with a double walled configuration and includes an inner wall 12*a* located inwardly of the upstanding wall 12. The inner walls of the container unit I*b* may be covered with a heat and sound insulating layer 40 which extends substantially completely about the interior of the container unit I*b* to enclose the lower portion of the operational or weapons unit I*a*.

As best seen in FIG. 2, the adapter unit II*a* is arranged to define an opening for the compartment 30 extending through the upper wall or deck 32 of the superstructure of the vessel. The adapter unit is configured essentially with a generally U-shaped configuration including a vertical wall 50, a lower horizontal wall 52 and an upper horizontally extending platform 54. A generally L-shaped rim portion 56 extends annularly around the adapter unit II*a* and joins together the wall 50 and the platform 54. The upper platform 54 includes a series of holes 58 extending therethrough and arranged in a predetermined spaced relationship about the periphery of the adapter unit II*a*. A plurality of vertically extending stiffening or support ribs 60 are provided around the adapter unit II*a* in order to firmly support the adapter unit upon the superstructure of the ship and to rigidly attach the adapter unit to the deck 32. Ribs 60 may be attached to the deck 32 by welds 62 and a welded connection 64 may be formed between each of the ribs 60 and the vertical wall 50 of the adapter units. Furthermore, the vertical wall 50 may be attached to the deck 32 by a welded seam 64 extending completely around the periphery of the adapter unit II*a*.

The adapter unit further includes a plurality of alignment pins 70 which are mounted beneath the platform 54 and which are upstanding therefrom in order to engage alignment holes formed in the container unit I*b* to enable lateral positioning and alignment of the sub-assembly I during placement thereof in mounting position within the compartment 30. The pins 70 are arranged with a predetermined uniform spacing around the adapter unit II*a* and they are affixed to the adapter unit by mounting means 72 which include a lower horizontal lip 74 against which the pins 70 abut in order to limit any downward movement thereof. A block 76 has formed therein a generally cylindrical opening 78 within which the pins 70 may be received in order to hold the pins 70 in proper upstanding position to effect their alignment function. Further stability in the mounting of the pins 70 is achieved by forming the pins to extend through holes 58*a* formed through the platform 54, the holes 58*a* being selected from among the holes labeled 58 which extend through the platform 54 of the adapter unit II*a*.

Figure 4:
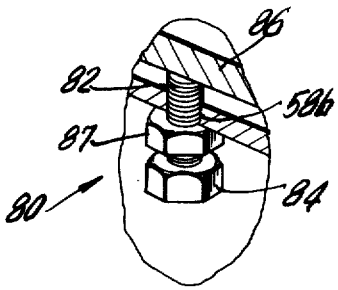
FIG. 4 is a more detailed view showing in an enlarged form the adjustment means of the invention whereby the attitude of the modular sub-assembly may be adjusted prior to final attachment thereof.

The adapter unit II*a* is also provided with adjustment means 80 shown in greater detail in FIG. 4 which enable adjustment of the position and attitude of the sub-assembly I after it has been placed in mounting position upon the adapter unit II*a*. The adjustment means 80 comprise a series of adjustment bolts 82 which extend in threaded engagement through threaded openings 58*b* formed through the platform 54 of the adapter unit II*a*. The threaded holes 58*b* may be selected from among the holes 58 previously mentioned. Each of the bolts 82 may be formed with a head 84 enabling rotation of the bolt 82 with a lock nut 87 being provided to maintain the bolt 82 in position after an adjustment has been made. It wil be noted that the bolts 82 extend upwardly from the platform 54 and may be raised or lowered by turning thereof in threaded engagement with the threaded hole 58*b*. By means of this adjustment of the bolts 82, the bolts may be brought into engagement with a portion of the container unit I*b* in order to adjust the position and orientation of the sub-assembly I in a manner to be more fully described hereinafter.

The container unit I*b* is formed with outer peripheral dimensions generally coinciding with the dimensions of the opening defined by the adapter unit II*a*. Furthermore, the general shape and configuration of the periphery of the container unit I*b* must coincide within certain predetermined tolerance limits with the shape and configuration of the portions of the adapter unit II*a* which define the opening in the compartment 30. For example, the outer upstanding walls 12 must define the outer limits of the container unit I*b* in such a manner that the container unit may extend to within the vertical wall 50 of the adapter unit II*a*.

The container unit I*b* includes a generally L-shaped rim 81 which extends horizontally outwardly from the outer wall 12. The L-shaped rim 81 includes a horizontal leg 83 and a vertical leg 85. A generally horizontally extending flange 86 is connected to the vertical leg 85 of the L-shaped rim 81 by welded seams 88 which attach the rim 86 to the container unit I*b* about the entire periphery thereof. A plurality of pouring holes 90 are formed through the flange 86 at spaced locations about the periphery of the container unit I*b*.

From the foregoing it will be seen that the container unit I*b* and the adapter unit II*a* each comprise parts thereof which are designed to mate with each other and which will form a set of complementary interfitting members to enable the sub-assembly I to be mounted in place on the vessel. These mating parts are the L-shaped rims 56 and 81, the flanges or platforms 54 and 86, the pins 70 and the holes designed therefor and the adjustment means 80.

In the manufacture of the assembly of the present invention, the entire modular operational unit sub-assembly I is completely prefabricated at a location remote from the mounting location in the vessel. The operational unit I*a*, which, as previously discussed, may be any one of a number of different types of units, is assembled together with the container unit I*b*. The inner structure of the container unit is, during the prefabrication process, adapted to the varying shapes and configurations of the different operational units I*a* which may be prefabricated therewith. Thus, the interior portions of the container unit I*b* must be capable of structural variation in order to be adapted to have enclosed and structurally connected therewith any number of operational units I*a* such as the weapons unit depicted in FIG. 1.

Although the interior parts of the container unit I*b* must be varied in order to adapt the container unit to receive various operational units I*a*, the external dimensions, configuration and arrangement of the container unit I*b*, particularly the mating parts such as the L-shaped rim 81 and the platform or flange 86, must be formed of a standardized uniform size and arrangement in order that they may directly mate with complementary parts on the adapter unit II*a*. Of course, the outer wall 12 of the container unit I*b* must be arranged such that the outer dimensions of the container unit will fit within the confines of the vertical wall 50 of the adapter unit II*a*. Furthermore, the flange 86 must be drilled with appropriate holes either for receiving therethrough the pins 70 or for enabling final rigid assembly of the container unit I*b* with the adapter unit II*a* by means of bolt connections 92.

After the operational unit I*a* and the container unit I*b* have been prefabricated into a single modular sub-assembly I, and after all sub-assembly prefabrication operations have been completed, the completed sub-assembly I is then lowered through the opening defined by the adapter unit II*a* into the compartment 30. As the sub-assembly I is lowered, the flange 86 will be brought down over the platform 54. The flange 86 is formed with a plurality of holes 94 accurately located at spaced positions around the sub-assembly I, and the sub-assembly I is lowered, the pins 70 will become aligned with the holes 94 and will pass therethrough in order to laterally guide the sub-assembly I into position within the compartment 30. After the sub-assembly I has been brought to rest at its lowered position, the bolts 82 of the adjustment means 80 will be arranged to bear against the underside of the flange 86. Since the sub-assembly I, at this time, is supported by means of the flange 86, adjustment of the bolts 82 will serve to adjust the attitude or orientation of the entire sub-assembly I. Thus, by manipulation of the bolt head 84 in order to threadedly rotate the bolts 82 through the threaded holes 58*b* in the platform 54, the upper ends of the bolts 82 may be brought into abutment with the underside of the flange 86 and by appropriate adjustment, the entire sub-assembly I may be brought into its desired attitude and orientation.

Since the adjustment means 80 are spaced at appropriate locations around the periphery of the sub-assembly I, each may be individually adjusted to a desired position and after such adjustment the locking nuts 87 may be tightened to maintain the bolts 82 with the sub-assembly I in the desired orientation.

After appropriate adjustment of the attitude and orientation of the sub-assembly I, the entire sub-assembly is firmly mounted and attached in place within the compartment 30. A primary element of the sealing arrangement of the assembly of the invention is an annular L-shaped sealing ring 100 which is formed between the L-shaped rims 56 and 80 and which comprises resilient sealing means extending completely around the sub-assembly I and providing not only a fluid-tight seal but also a resilient mounting member which accommodates tolerance errors in the overall construction of the device as well as shock forces which may occur during operation of the finished assembly.

Figure 3:
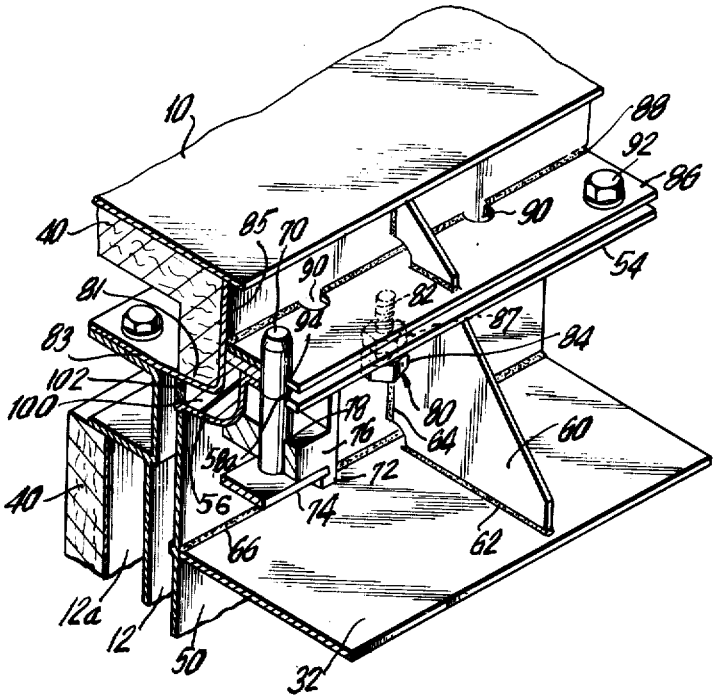
FIG. 3 is a perspective view in section showing in greater detail the interfitting arrangement between the modular sub-assembly and the adapter unit on the ship by means of which the sub-assembly of the invention may be interfittingly connected with the ship in an interchangeable manner by utilization of standardized mounting parts.

The sealing means 100 comprises synthetic plastic material which is poured into place through the pouring holes 90 in the flange 86. The synthetic plastic material is poured while in a liquid or fluid state and is permitted to fill a gap which is formed between the L-shaped rims 56 and 81. The material of the sealing means 100 is poured after the sub-assembly I has been lowered in place to within the compartment 30 and after the adjustment means 80 have been operated to achieve the proper positioning of the sub-assembly. After pouring of the liquid sealing material, the material is permitted to harden in order to form the annular L-shaped sealing ring shown in FIG. 3 which extends completely around the sub-assembly I. In order to ensure that the sealing plastic 100 properly fills the gap between the rims 56 and 81, a stopper strip 102 is applied on a side of the gap between the rims 56 and 81 closest to the interior of the assembly. The strip 102 may be applied by adhering an edge thereof onto the inner end of the rim 56 prior to movement in place of the sub-assembly I. Thus, with the sub-assembly I removed, and with the adapter unit II*a* in the condition depicted in FIG. 2, the stopper strip 102 may be glued or otherwise fastened around the edge of the adapter unit II*a* which is formed between the veritcal wall 50 and the horizontal leg of the rim 56. The strip 102 will extend completely around the adapter unit and it will be of a width sufficient to abut the horizontal leg 83 of the rim 81. Thus, when the sub-assembly I is brought into place with the flange 86 overlying the platform 54, the ring 102 will seal the gap between the rims 56 and 81 and thus retain therein the liquid plastic material which is poured through the holes 90 to form the sealing ring 100.

In order to facilitate subsequent removal of the sub-assembly I, the portions of the container unit I*b* which come in contact with the plastic sealing material 100 may, preferably, be coated with a separating agent such as grease, or silicone separators such as teflon to prevent the plastic material from adhering to the container unit I*b*. However, the portions of the adapter unit II*a* are not coated and the plastic material is permitted to adhere to the adapter unit. The separating agent is generally applied across the surface of the L-shaped rim 81 and portions of the flange 86. As a result, when it is desired to remove the sub-assembly I from its mounting position in order to provide replacement thereof with another sub-assembly having a different operational unit I*a*, the rim 81 may become easily separated from the sealing strip 100 and the sealing strip 100 will remain in place adhered to the rim 56 on the adapter unit II*a*. Furthermore, inasmuch as the stopper 102 is adhered only to the edge of the rim 56 and not to the horizontal leg 83 of the rim 81, it will not interfere with separation of the sub-assembly I from the adapter unit II*a*.

Thus, it will be seen that, as a result of the structure and arrangement of the present invention, the sub-assembly I may be mounted in place upon the vessel in a firm, fluid-tight engagement while being readily removable when desired. The sealing ring 100 not only provides a fluid-tight seal, but it also operates, due to its resiliency, to absorb shocks and recoil forces which may develop during the operation of the unit I*a*. Of course, after the sealing means 100 has been poured in place and permitted to harden, additional fastening means such as bolting connections 92 may be applied to ensure a rigid and firm mounting of the sub-assembly I. However, such additional mounting or attachment means should be such as to be easily removable if and when the sub-assembly I is to be removed and replaced.

Thus, it will be seen that with the construction in accordance with the present invention several distinct advantages are achieved in the installation of operational units on a ship. The deck of the ship may be provided with a plurality of adapter units such as the unit II*a* each of which will be of a standardized uniform size and configuration and each of which will be adapted to receive any one of a number of container units I*b*. As a result, replacement of a sub-assembly I with a different operational unit I*a* may be accomplished within a short period of time possibly a few hours. Furthermore, individual units may be moved from one location on the ship to another without difficulty. The operational unit I*a* may be assembled and completely tested at a location remote from the ship and it may be installed easily upon the ship in a condition wherein the operational unit I*a* is completely functional and ready for operation. Furthermore, because of the specific arrangement of the mating parts of the adapter unit II*a* and the container unit I*b*, and due to the fact that a resilient sealing strip is provided between the rims 56 and 81, dimensional tolerance limitations are reduced and the parts of the assembly need not be precisely dimensioned in order to achieve an appropriate fit between the standardized mating components of the elements of the assembly. Not only is ease of replacement of different operational units enabled, but at the same time a completely water-tight seal is provided and enhanced ability to handle considerable recoil forces or other shocks is achieved. The adapter unit II*a* not only defines a mounting site having standardized dimensions relative to other mounting sites and relative to the container unit I*b*, but it also increases the rigidity of the ship's superstructure within the region of the hatch opening thereby providing a more firm and reliable mounting seat. The invention enables a great diversity and versatility with regard to the types of operational units I*a* which may be interchangeably mounted upon a warship and thereby greatly increases the effectiveness of the warship while materially reducing the time and costs necessary for placing the warship in operational condition.

While a specific embodiment of the invention has been shown and described in detail to illustrate the application of the inventive principles, it will be understood that the invention may be embodied otherwise without departing from such principles.

What is claimed is:

1. A containerized modular assembly particularly for interchangeable mounting of operational units on warships by remote prefabrication of said operational units into operational unit sub-assemblies capable of interchangeable mounting upon said warship by standardized uniformly configured mating means, said assembly comprising: an operational unit; container means having said operational unit mounted therein in a manner to enable functioning interconnection of said operational unit with said warship when mounted thereon; said operational unit and said container means being structurally combined as a unitary prefabricated modular operational unit sub-assembly; means defining on said warship a compartment adapted to receive therein said modular operational unit sub-assembly; adapter means including portions thereof defining adapter mating means formd of a standardized predetermined size and configuration, said adapter means being structurally formed as a part of said warship to define an opening for said compartment; container mating means formed from parts of said container means with a standardized predetermind size and configuration complementary to the size and configuration of said adapter mating means; said adapter mating means and said container mating means being in mounting engagement with each other to operatively mount said operational unit sub-assembly upon said warship within said compartment; adjustment means interposed between said adapter means and said container means for enabling adjustment of the attitude and orientation of said operational unit relative to said warship after said modular sub-assembly has been introduced into said compartment and movably arranged in mounting position by engagement between said adapter mating means and said container mating means; resilient sealing means extending in sealing engagement completely around said container means between said adapter mating means and said container mating means to form a fluid-tight seal therebetween; and means for enabling application of said sealing means to effect said fluid-tight seal after said operational unit sub-assembly has had its attitude and orientation relative to said warship adjusted by operation of said adjustment means; said assembly further including means for enabling separation of said sealing means from between said adapter means and said container mating means to permit dismounting of said operational unit sub-assembly from said warship and mounting in the place thereof of another prefabricated modular operational unit sub-assembly having container means with substantially identical standardized container mating means, said adapter mating means and said container mating means each including complementary rims forming an annular gap therebetween which extends completely around said container means and which is adapted to receive therein said resilient sealing means, said assembly further including a stopper strip in abutting relationship between said adapter mating means and said container mating means closing off the innermost side of said annular gap, said container mating means having formed therein orifice means spaced around said container means in flow communication with said annular gap on the outermost side thereof to enable pouring therethrough of said sealing means while in liquid form to fill said annular gap. --

2. An assembly according to claim 1 wherein said resilient sealing means is firmly adhered to said adapter mating means and including a separating agent coated upon said container mating means to facilitate separation of said sealing means from said container mating means.

3. An assembly according to claim 1 including alignment means arranged to become engaged between said adapter means and said container means when said modular operational unit sub-assembly is placed in mounting position upon said warship with said container mating means and said adapter mating means brought into interfitting mounting relationship, said alignment means extending generally vertically relative to said warship and operating to effect lateral alignment of said modular sub-assembly in mounting position relative to said warship.

4. An assembly according to claim 3 wherein said alignment means comprise a plurality of vertically upstanding pins mounted upon said adapter means at predetermined spaced locations thereabout, and alignment holes formed in said container means at predetermined spaced locations thereabout coinciding with the spaced locations of said pins in order to guide said modular sub-assembly into mounting position by interengagement of said alignment holes with said pins.

5. A containerized modular assembly particularly for interchangeable mounting of operational units on warships by remote prefabrication of said operational units into operational unit sub-assemblies capable of interchangeable mounting upon said warship by standardized uniformly configured mating means, said assembly comprising: an operational unit; container means having said operational unit mounted therein in a manner to enable functioning interconnection of said operational unit with said warship when mounted thereon; said operational unit and said container means being structurally combined as a unitary prefabricated modular operational unit sub-assembly; means defining on said warship a compartment adapted to receive therein said modular operational unit sub-assembly; adapter means including portions thereof defining adapter mating means formed of a standardized predetermined size and configuration, said adapter means being structurally formed as a part of said warship to define an opening for said compartment; container mating means formed from parts of said container means with a standardized predetermined size and configuration complementary to the size and configuration of said adapter mating means; said adapter mating means and said container mating means being in mounting engagement with each other to operatively mount said operational unit sub-assembly upon said warship within said compartment; adjustment means interposed between said adapter means and said container means for enabling adjustment of the attitude and orientation of said operational unit relative to said warship after said modular sub-assembly has been introduced into said compartment and movably arranged in mounting position by engagement between said adapter means and said container mating means; resilient sealing means extending in sealing engagement completely around said container means between said adapter mating means and said container mating means to form a fluid-tight seal therebetween; and means for enabling application of said sealing means to effect said fluid-tight seal after said operational unit sub-assembly has had its attitude and orientation relative to said warship adjusted by operation of said adjustment means; said assembly further including means for enabling separation of said sealing means from between said adapter means and said container mating means to permit dismounting of said operational unit-sub-assembly from said warship and mounting in the place thereof of another prefabricated modular operational unit sub-assembly having container means with substantially identical standardized container mating means, said adapter mating means and said container mating means each including complementary L-shaped rims forming an L-shaped annular gap therebetween which extends completely around said container means and which is adapted to receive therein said resilient sealing means, said assembly further including a stopper strip in abutting relationship between said adapter mating means and said container mating means closing off the innermost side of said annular gap, said container mating means having formed therein orifice means spaced around said container means in flow communication with said annular gap on the outermost side thereof to enable pouring therethrough of said sealing means while in liquid form to fill said annular gap.

6. A containerized modular assembly particularly for interchangeable mounting of operational units on warships by remote prefabrication of said operational units into operational unit sub-assemblies capable of interchangeable mounting upon said warship by standardized uniformly configured mating means, said assembly comprising: an operational unit; container means having said operational unit mounted therein in a manner to enable functioning interconnection of said operational unit with said warship when mounted thereon; said operational unit and said container means being structurally combined as a unitary prefabricated modular operational unit sub-assembly; means defining on said warship a compartment adapted to receive therein said modular operational unit sub-assembly; adapter means including portions thereof defining adapter mating means formed of a standardized predetermined size and configuration, said adapter means being structurally formed as a part of said warship to define an opening for said compartment; container mating means formed from parts of said container means with a standardized predetermined size and configuration complementary to the size and configuration of said adapter mating means; said adapter mating means and said container mating means being in mounting engagement with each other to operatively mount said operational unit sub-assembly upon said warship within said compartment; adjustment means interposed between said adapter means and said container means for enabling adjustment of the attitude and orientation of said operational unit relative to said warship after said modular sub-assembly has been introduced into said compartment and movably arranged in mounting position by engagement between said adapter mating means and said container mating means; resilient sealing means extending in sealing engagement completely around said container means between said adapter mating means and said container mating means to form a fluid-tight seal therebetween; and means for enabling application of said sealing means to effect said fluid-tight seal after said operational unit sub-assembly has had its attitude and orientation relative to said warship adjusted by operation of said adjustment means; said assembly further including means for enabling separation of said sealing means from between said adapter means and said container mating means to permit dismounting of said operational unit sub-assembly from said warship and mounting in the place thereof of another prefabricated modular operational unit sub-assembly having container means with substantially identical standardized container mating means, said container means including generally horizontally extending flange means with said adjustment means comprising screw means threadedly engaging said adapter means and extending upwardly therefrom for abutment with the underside of said flange means said screw means being arranged at individual locations around said adapter means to enable tilting of said modular sub-assembly by threaded adjustment of said screw means thereby to effect adjustment of the attitude and orientation of said operational unit relative to said warship, said adapter mating means and said container mating means each including complementary L-shaped rims defining an L-shaped annular gap therebetween which extends completely around said container means and which is adapted to receive therein said resilient sealing means, said means for enabling application of said sealing means comprising orifice means spaced at individual locations around said container means and extending through said flange means into flow communication with said annular gap to permit poiring through said orifice means and into said annular gap of said sealing means while in a liquid form.

7. A containerized modular assembly particularly for interchangeable mounting of operational units on warships by remote prefabrication of said operational units into operational unit sub-assemblies capable of interchangeable mounting upon said warship by standardized uniformly configured mating means, said assembly comprising: an operational unit; container means having said operational unit mounted therein in a manner to enable functioning interconnection of said operational unit with said warship when mounted thereon; said operational unit and said container means being structurally combined as a unitary prefabricated modular operational unit sub-assembly; means defining on said warship a compartment adapted to receive therein said modular operational unit sub-assembly; adapter means including portions thereof defining adapter mating means formed of a standardized predetermined size and configuration, said adapter means being structurally formed as a part of said warship to define an opening for said compartment; container mating means formed from parts of said container means with a standarized predetermined size and configuration complementary to the size and configuration of said adapter mating means; said adapter mating means and said container mating means being in mounting engagement with each other to operatively mount said operational unit sub-assembly upon said warship within said compartment; adjustment means interposed between said adapter means and said container means for enabling adjustment of the attitude and orientation of said operational unit relative to said warship after said modular sub-assembly has been introduced into said compartment and movably arranged in mounting position by engagement between said adapter mating means and said container mating means; resilient sealing means extending in sealing engagement completely around said container means between said adapter mating means and said container mating means to form a fluid-tight seal therebetween; and means for enabling application of said sealing means to effect said fluid-tight seal after said operational unit sub-assembly has had its attitude and orientation relative to said warship adjusted by operation of said adjustment means; said assembly further including means for enabling separation of said sealing means from between said adapter means and said container mating means to permit dismounting of said operational unit sub-assembly from said warship and mounting in the place thereof of another prefabricated modular operational unit sub-assembly having container means with substantially identical standarized container mating means, said container mating means including a generally horizontal flange extending around said container means and an L-shaped rim extending from said flange downwardly and inwardly of said container means, said adapter mating means including a generally horizontal platform extending along said adapter means around said opening for said compartment and an L-shaped rim extending from said flange means downwardly and inwardly of said compartment, said flange on said container mating means extending to overlie said platform on said adapter means when said modular operational unit sub-assembly is in mounting position within said compartment with said L-shaped rims being located in a spaced apart relationship coextending around said sub-assembly to define a circumferential L-shaped gap thereabout, said means for enabling application of said sealing means including an annular stopper strip extending around said sub-assembly in abutting relationship between said L-shaped rims to close off the innermost side of said L-shaped gap and a plurality of orifices extending through said flange on said container means in flow communication with the outermost side of said L-shaped gap to enable pouring therethrough of said sealing means in liquid form, said adjustment means including screw means threadedly engaging said platform on said adapter means and extending upwardly therefrom for abutment against the underside of said flange on said container means, said screw means being arranged at individual locations around said modular operational unit sub-assembly to enable tilting thereof by threaded adjustment of said screw means to thereby effect adjustment of the attitude and orientation of said operational unit relative to said warship, said assembly further including pin means extending upwardly from said platform on said adapter means at individual locations around said opening of said compartment and alignment holes extending through said flange on said container means at individual locations around said container means coincident with said locations of said pin means to permit lateral alignment of said modular operational unit sub-assembly in mounting position on said warship by engagement of said pin means within said alignment holes when said modular sub-assembly is placed into said compartment through said opening defined by said adapter means.

* * * * *